US012698566B2

(12) United States Patent
Van Niekerk et al.

(10) Patent No.: US 12,698,566 B2
(45) Date of Patent: Aug. 4, 2026

(54) ELECTROCHEMICAL DEVICE FOR PRODUCING BIOCIDE SOLUTIONS

(71) Applicant: SURETOL LIMITED, Clonmel (IE)

(72) Inventors: David-Lee Van Niekerk, Clonmel (IE); Brendan Kennedy, Kilmacow (IE); Kevin Keane, Kilmacthomas (IE); Edmond O'Reilly, Carrigaline (IE)

(73) Assignee: Suretol Limited, Clonmel (IE)

( * ) Notice: Subject to any disclaimer, the term of this patent is extended or adjusted under 35 U.S.C. 154(b) by 581 days.

(21) Appl. No.: 18/037,639

(22) PCT Filed: Nov. 19, 2021

(86) PCT No.: PCT/EP2021/082349

§ 371 (c)(1),
(2) Date: May 18, 2023

(87) PCT Pub. No.: WO2022/106644

PCT Pub. Date: May 27, 2022

(65) Prior Publication Data

US 2024/0003020 A1 Jan. 4, 2024

(30) Foreign Application Priority Data

Nov. 19, 2020 (GB) ..... 2018207

(51) Int. Cl.

| | |
|---|---|
| ***C25B 9/15*** | (2021.01) |
| ***C25B 1/26*** | (2006.01) |
| ***C25B 15/029*** | (2021.01) |
| ***C25B 15/08*** | (2006.01) |

(52) U.S. Cl.

CPC ..... *C25B 9/15* (2021.01); *C25B 1/26* (2013.01); *C25B 15/029* (2021.01); *C25B 15/087* (2021.01)

(58) Field of Classification Search

CPC ..... C25B 9/15; C25B 1/26; C25B 15/029; C25B 15/087; C25B 1/46; C25B 9/07; C25B 15/023; C02F 1/4674; C02F 2001/46152; C02F 2103/026; C02F 1/46104; A61L 2/18

See application file for complete search history.

(56) References Cited

U.S. PATENT DOCUMENTS

| | | | | |
|---|---|---|---|---|
| 2005/0029093 | A1* | 2/2005 | Rawhani | C02F 1/46104 204/267 |
| 2008/0003507 | A1* | 1/2008 | Nanjundiah | C01B 11/024 252/62.2 |
| 2011/0135562 | A1* | 6/2011 | Niksa | C25B 15/00 205/345 |
| 2011/0189302 | A1* | 8/2011 | Van Niekerk | C02F 1/4674 204/229.8 |
| 2013/0236569 | A1* | 9/2013 | Van Niekerk | A01N 59/00 424/661 |
| 2014/0367247 | A1* | 12/2014 | Croke | C25B 15/02 204/229.8 |
| 2016/0108528 | A1* | 4/2016 | Lin | C25B 15/08 204/278 |
| 2017/0298552 | A1* | 10/2017 | Arai | A61L 2/18 |
| 2017/0321330 | A1* | 11/2017 | Malhotra | C25B 1/26 |
| 2018/0371629 | A1* | 12/2018 | Ellis | C02F 1/46104 |
| 2024/0003020 | A1* | 1/2024 | Van Niekerk | C25B 1/46 |

FOREIGN PATENT DOCUMENTS

JP H10174971 A 6/1998

OTHER PUBLICATIONS

Combined Search and Examination Report in GB Application No. 2018207.7 mailed on May 5, 2021.
International Search Report and Written Opinion in PCT/EP2021/082349 mailed on Apr. 21, 2022.

* cited by examiner

*Primary Examiner* — Muhammad S Siddiquee
(74) *Attorney, Agent, or Firm* — Schmeiser Olsen, PLLC

(57) ABSTRACT

Electrochemical device for producing biocide solutions A device for producing biocidal solutions comprising a flow through undivided electrochemical cell for electrochemically activating an electrolyte to produce an electrochemically activated solution which is biocidal, the electrochemical cell having an anode and a cathode, wherein the separation between the anode and the cathode is less than 3.0 mm and the electrochemical cell having a capacity to hold no more than 20 ml of electrolyte within the electrochemical cell.

18 Claims, 1 Drawing Sheet

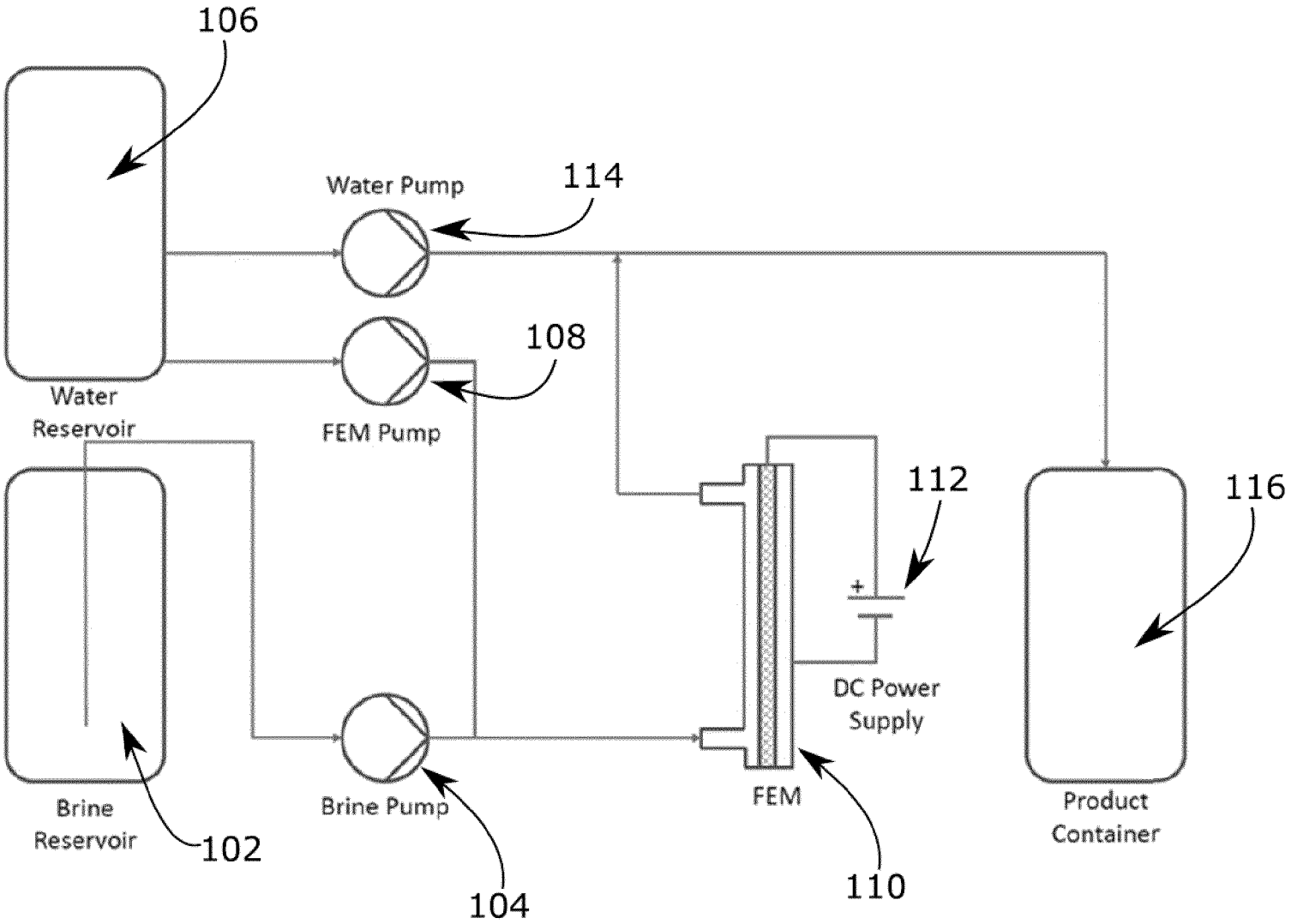
116
Product Container
112
DC Power Supply
+
110
FEM
114
Water Pump
108
FEM Pump
104
Brine Pump
106
Water Reservoir
102
Brine Reservoir

ELECTROCHEMICAL DEVICE FOR PRODUCING BIOCIDE SOLUTIONS

FIELD OF THE INVENTION

The present invention relates to electrochemical devices, electro chemical activation, and electrolysis.

BACKGROUND TO THE INVENTION

Electrolysis cells are used for the generation of biocidal solutions. Such solutions are used for purposes such as sanitising water, surfaces and processing equipment. Many types and designs of electrolysis cells are available. All such electrochemical cells comprise an anode, at which oxidation occurs, and a cathode, at which reduction occurs. By way of example the oxidation of chloride ion to chlorine may occur at the anode and the reduction of water to hydrogen may occur at the cathode. Many electrochemical cells further comprise a diaphragm or membrane that is semi-permeable or selectively permeable to all or certain chemical species; with said diaphragm or membrane being disposed between the anode and cathode such that the cell is divided into an anode chamber and a cathode chamber.

By Faraday's law of electrolysis, the rate at which product is generated in electrochemical cells is proportional to the current. Frequently several electrochemical reactions can occur simultaneously at an electrode and the relative rates of reaction, and therefore the relative proportions of the products, are to a large extent controlled by the voltage drop at the electrode.

Between the two electrodes there is also a potential drop associated with the resistance of the solution. The resistance of the solution is determined by the separation of the electrodes and the conductivity of the solutions.

The cell voltage is the sum of the potential drops across both electrodes, the cell solution and the diaphragm or membrane. Therefore, control of the potential drop across the cell solution is of high importance.

The optimisation of cell potential and current is also advantageous with regards to the design of electrical circuitry needed to power the cell. Lower voltages and currents require less power and allow for the selection of power supplies and other electronic components that are safer and have lower requirements for heat dissipation.

The conversion of reactant to product is frequently of great importance in the design of electrochemical cells. By way of example the corrosivity of solutions of free available chlorine is minimised when the concentration of chloride ion in said solutions is also minimised.

Solutions produced from certain advanced cell designs are of minimal chloride concentration due to the reaction of chlorine gas with caustic soda (sodium hydroxide) external to the cell. Such designs are not practical in many applications due to reasons of cost and safety. In such applications flow through cell designs, where the pH is such that the product solution comprises free available chlorine, are of greater utility as chlorine is converted to free available chlorine (FAC) immediately upon production inside the cell. In these designs control of solution composition and electrode disposition are of critical importance.

The biocidal efficacy of free available chlorine solutions is optimised when the pH of said solutions are approximately 7. The dominant chemical species at this pH is hypochlorous acid, whereas the dominant chemical species at basic pH is sodium hypochlorite, a less powerful biocide than hypochlorous acid. (Hypochlorous acid (H—O—Cl) is a weak acid that forms when chlorine dissolves in water, and itself partially dissociates, forming hypochlorite, $ClO^-$. Sodium hypochlorite (also known as bleach) is a chemical compound with the formula NaOCl comprising a sodium cation (Na+) and a hypochlorite anion ($OCl^-$). It may also be viewed as the sodium salt of hypochlorous acid.)

The incentive to minimise waste also motivates the design of devices with cells that start up in a rapid fashion and achieve the desired product concentration quickly. This is particularly true for devices designed for consumer applications such as those designed for producing disinfectant solutions for dental applications. Optimised cell design is of crucial importance in achieving this goal.

Many generators on the market produce concentrate solutions which are subsequently dosed into carrier water to produce an at-use desired concentration. It is more difficult to design a device that produces solutions at the desired at-use concentrations directly from the device. The difficulty is compounded when the device is designed to produce output solutions at different concentrations which are selectable by the user.

Many small volume applications, for example less than 25 litres require a very stable concentration output. One such application is in dental water line disinfection. In this application the device must produce a small volume, often less than 2 litres and the concentration of oxidants must be low enough to eliminate or reduce the possibility of corrosion, yet high enough to be effective against a possible bacterial load. In applications like this the consistency of the output solution is critical. A significant hurdle in achieving consistent output occurs at start-up of the electrochemical device, where it takes some time to achieve stable output. The effect is the start-up concentration causes significant variation. The reason for this is the volume of the solution produced in the start-up phase as a proportion of the overall volume produced may have a significant effect on the overall output concentration.

For example International Publication WO2010012792 discloses an automated electrochemical device for generating a biocidal output solution, having a flow-through electrochemical cell comprising an anodic chamber and a cathodic chamber for electrolysing an electrolyte to generate an anolyte solution and a catholyte solution. The device also has: (i) a reservoir for storing catholyte; and (ii) a hydraulic circuit for recirculating catholyte from the reservoir to the anolyte on start-up of the cell, wherein input of catholyte of a compensating strength to the cell anodic chamber, is arranged so as to optimise the cell anolyte pH to produce a stable output solution at the start of the electrolysis process.

Consequently there is recognised need for a device configured to address these issues.

SUMMARY OF THE INVENTION

The present invention related to a device for producing biocidal solutions comprising a flow through undivided electrochemical cell for electrochemically activating an electrolyte to produce an electrochemically activated solution which is biocidal, the electrochemical cell having an anode and a cathode, wherein the separation between the anode and the cathode is less than 3.2 mm, such as less than 3.0 mm, and the electrochemical cell having a capacity to hold no more than 20 ml of electrolyte within the electrochemical cell.

The device of the invention comprises an undivided electrochemical cell. Accordingly it does not have a separator between the anode and the cathode, for example it does not have a membrane, ceramic, or diaphragm between the anode and the cathode. This confers certain advantages such as less overall cell resistance and therefore lower cell voltages.

It will be noted that the use of a separator such as a diaphragm or membrane necessarily results in the generation of two product streams from the cell. In certain applications both streams are useful. However, in many applications only one of the streams is useful and the other solution must be disposed of. This is often true of cells that produce caustic solutions (sodium hydroxide solutions) at the cathode and FAC solutions at the anode. The caustic solution is often disposed of with attendant costs, safety and environmental implications. These issues are avoided by the device of the invention.

As the pH of electrochemically activated solutions produced by the electrolysis of saline solutions in cells that are undivided by a membrane/diaphragm may be basic this can be an issue. However this is addressed by a kit and/or brine of the invention which can compensate for such basic pH, for example by suppressing/neutralising for example by using buffer and/or acid in the brine solution. It will be noted that the pH compensation can be added before electrolysis, during the electrolysis process or after the solution is generated. For example a component for pH compensation may be for a component for suppressing/neutralising sodium hydroxide produced by the electrochemical cell. The component may be added to the device of the invention. For example the device of the invention may include a reservoir for storing a component for suppressing/neutralising and which includes a supply conduit for supplying the component to a fluid feed for the electrochemical cell and/or the solution leaving the electrochemical cell.

For example the component for suppressing the production of sodium hydroxide by the electrochemical cell may be an acid or a buffer, for example hydrochloric acid.

The component for suppressing the sodium hydroxide may be used to impart a pH of from about 5 to 8 such as 6 to 7.5, for example 6.5 to 7.5, optionally 6.5 to 7.2 such as about pH 7 to the electrochemically activated solution.

The device of the invention is able to produce solutions of free available chlorine and/or mixed oxidants from single chambered flow through electrochemical cells. Furthermore the chloride concentration of said solutions is minimised, the concentration of impurities is minimised and wherein the pH of the solutions are optimised to maximise the concentration of hypochlorous acid therein.

Desirably in the present invention the separation between the anode and the cathode is no more than 2.8 mm, such as no more than 2.6 mm, for example no more than 2.5 mm. Small separation allows for better control of the output of the electrochemical cell. The separation is substantially constant.

Suitably the electrochemical cell has a capacity to hold no more than 18 ml of electrolyte, such as no more than 16 ml, for example no more than 14 ml, desirably no more than 12 ml, optionally no more than 10 ml. Smaller amounts of electrolyte mean smaller residual amounts of electrolyte in the electrochemical cell when the device ceases production of electrochemically activated solutions.

For example the electrochemical cell may have a capacity to hold no more than 8 ml of electrolyte, such as no more than 7 ml, for example no more than 6 ml, desirably no more than 5 ml.

A device according to the present invention may be configured to run in production cycles so as to produce a predetermined amount of electrochemically activated solution and then cease production when the predetermined amount of electrochemically activated solution is produced. It will be appreciated that a production cycle can be automated.

A device according to the present invention may be configured to, for example, automated to, flush residual electrolyte from the electrochemical cell after a production cycle of electrochemically activated solution ceases. In this respect it will be appreciated that such residual electrolyte may be at least electrochemically activated solution. This has a number of advantages. The residual electrolyte will not corrode the electrochemical cell and/or residual electrolyte is less likely to degrade when no longer in contact with the anode/cathode.

A device according to the present invention may comprise a flush system wherein a liquid, such as water, for example deionised water, is used to flush residual electrolyte out of the electrochemical cell. Water is less likely to cause degradation of the electrochemical cell, for example where there are longer time lapses between production cycles.

Desirably the flushed residual electrolyte is retained within the device. This avoids the need for a waste stream or a recycle/recirculation stream. For example the device according to the present invention does not have a recirculation system. A recirculation system recirculates the electrolyte that has been through the cell until such time as it reaches one or more criteria of a desired output such as a desired concentration of free available chlorine and/or a desired pH.

Furthermore where the device has means for diluting the electrochemically activated solution, such as means for dilution with water, for example deionised water, the flush can be done utilising the means for dilution. This obviates the necessity for a separate purge/flushing system.

Suitably the device has a discharge conduit for discharging electrochemically activated solution from the device and the flushed residual electrolyte is retained within the discharge conduit. Because the volumes of the electrochemical cell are low this means that there is no requirement for a separate waste/recycle/recirculation system. The volumes are small enough to be held within a discharge conduit.

Another advantage of the present device is that residence time (time electrolyte spends within the electrochemical cell) is low.

Accordingly a device according to the invention has a very short start up time to reach a state where it produces desirable output electrochemically activated solution.

For example the discharge conduit may include a U-bend tube. Providing a simple U-bend is a simple way of increasing capacity in the discharge conduit without having to enlarge its cross-sectional area and/or provide some form of reservoir.

The device of the invention may be configured so that the flushed residual electrolyte is mixed with a volume of electrochemically activated solution produced from a subsequent production cycle. For example the volume of electrochemically activated solution with which it is mixed may be at least 10 times, such as at least 15 times, for example at least 20 times such as at least 30 times, the volume of the flushed residual electrolyte. This is easily achieved where the device of the invention is provided with means for diluting, for example dilution with water such as deionised water, and dispensing the electrochemically activated solution produced in the electrochemical cell Overall then residual electrolyte is pushed out of the electrochemical cell into a dispensing conduit and held there until a next production cycle. From there it can be mixed into the electrochemically activated solution and/or a diluted electrochemically activated solution. Its volume will be low relative to that of the electrochemically activated solution so it will not make any significant difference to the concentration of active species in the electrochemically activated output solution.

The device of the invention may be configured so that the flushed residual electrolyte and the liquid that flushed it are both mixed with a volume of electrochemically activated solution produced from a subsequent production cycle wherein the volume of electrochemically activated solution with which it is mixed is at least 10 times, such as at least 15 times, for example at least 20 times such as at least 30 times, the combined volume of the flushed residual electrolyte and the liquid that flushed it.

Desirably a device of the invention includes a voltage control for maintaining a voltage of between 2 and 7.5 volts across the electrochemical cell. For example the voltage control may be used to control the current drawn by the electrochemical cell so that a constant current is maintained. In this way the voltage control may be used to control the electrochemical activation of the electrochemically activated solution.

Suitably a device of the invention further comprises means for applying a DC voltage to the electrochemical cell. Suitably a device of the invention further comprises means for controlling the current in the electrochemical cell.

Desirably a device of the invention further comprises a reservoir for brine and a means for delivering brine to the electrochemical cell. For example a brine pump such as a diaphragm pump may be employed to supply brine to the electrochemical cell.

The use of a brine reservoir is advantageous. The brine concentration can be accurately formulated, as compared to the use of salt saturators, allowing for greater control of electrochemical cell operation and voltages. The composition of the brine can be varied by using additives that can impart desirable properties to the final biocide solution. For example, such as in a kit and/or a brine of the invention, a component for reducing pH such as buffer or acid e.g. hydrochloric acid can be added to the device, for example to the brine so that the pH of the biocidal FAC solutions produced from the undivided cell is optimised to neutral or near neutral pH without the concomitant production of unwanted waste streams of caustic (sodium hydroxide).

As in a kit and/or brine of the invention, or indeed by any suitable means other additives, such as sodium chlorite that is oxidised to chlorine dioxide at anode surfaces, can be added to the device, for example to brine solutions to boost the quantity of minor oxidant species in mixed oxidant solutions. Salts such as sodium chlorite are hazardous and it would be difficult to control the concentration of said minor components through any means other than the use of a pre-formulated solution. Dissolution in a saturator containing mixed salts/precursors would result in insufficient control over concentrations and ratios of components.

The absence of a diaphragm or membrane in the cell is also advantageous. The cell potential is reduced. Fouling of membranes or diaphragms adversely affects the cell potential and cleaning or replacement of same is required to recover cell potential. Cleaning of cells without such separators is simpler.

The disposition of the anode and cathode optimises the performance of the cell. The separation, i.e., the distance, between the anode and cathode defines an electrode separation. Cells with large electrode separation present higher resistances to current flow than cells of smaller electrode separation. The voltage required to sustain a given current, at constant solution conductivity, is higher for cells of larger electrode separation. More power is required to operate such cells and more undesirable by-products can be produced.

Furthermore, the conversion of chloride to free available chlorine in such cells is limited by the electrode separation. Electrochemical reactions occur at electrode surfaces and solution that does not encounter the surface is unaffected by such reactions. The chamber volume/capacity of cells with larger electrode distance is by definition larger and more of this solution will not encounter the electrode surface.

Hydrogen gas is produced at the cathode of typical cells described heretofore. This gas can bridge the gap between the electrodes. This can prevent electrolysis reactions from taking place, adversely affecting cell performance. Such bridging happens more often at smaller electrode distances.

Therefore, there are optimal values for electrode distance/separation in undivided cells. In one embodiment of this invention the optimal distance is approximately 1 mm.

The electrode separation is also of critical importance in enabling cells to start up quickly. Again, the reason is that for large electrode separations a great deal of the reactant does not encounter the electrode surface and it takes time for the product concentration to build to the desired value.

Two metrics are used to measure cell performance on start-up. The first is the termed the start-up volume defined as the volume of liquid that must pass through a cell on start-up, through which the reactant solution flows but which initially contains no product, such that the concentration of product in the stream exiting the cell is greater than 90% of the steady state operating concentration.

The second is a normalised metric for measuring the performance of cells with regard to start up performance is defined in this application. This metric is a residence time and is the ratio of two parameters.

The numerator of the ratio is the start-up volume as defined previously. The denominator of the ratio is the flow rate of liquid through the cell.

Solutions of hypochlorous acid and/or mixed oxidants are used for disinfection purposes in applications that vary in scale by many orders of magnitude. Municipal water treatment uses hypochlorous acid on the kg/tonne scale to produce potable water. At the other end of the scale, disinfection of dental unit water lines requires mg of oxidant dosed into small volumes of water, typically less than 2 litres in volume.

In large scale applications fluctuations in precursor concentrations and variations in production methods do not result in substantial variation in final FAC/mixed oxidant concentration due to the scale of the process. In small scale applications, where milligrams of oxidant are produced, such fluctuations and variations readily affect the concentration of oxidant in the product.

The design of the device for producing biocidal solutions described in this application is such that the use of a brine reservoir (with the resultant facility to accurately control the composition of said brine and additives therein), the use of an undivided electrochemical cell of optimised electrode distance (resulting in a small cell volume), and the use of accurate electronic and electrical control systems allows for rapid generation of small volumes of solutions of repeatedly consistent concentration. Such volumes are of ml or litre volume up to 25 litres.

A further requirement of many consumer applications, such as dental applications, is to produce solutions of different concentrations for different purposes. By way of example the maintenance of dental unit water lines such that they remain free of biofilm growth requires solutions of mixed oxidant/hypochlorous acid of concentration less than 10 ppm. However dental unit water lines that have been poorly maintained typically have substantial growth of biofilm and such water lines are often "shock dosed" with solutions of a much higher ppm of hypochlorous acid before they can be maintained biofilm free with low concentrations on a continual basis.

The device of the present invention can produce an electrochemically activated solution comprising from about 0.5 to about 1500 ppm free available chlorine (FAC). For example the electrochemically activated solution produced by the electrolytic cell may comprise from about 0.5 to about 1500 ppm. The electrochemically activated solution produced by the electrolytic cell may be diluted with a diluent, for example water, before the electrochemically activated solution is delivered to a product container. The diluent may be pumped, for example by a water pump, or may flow by gravity. The electrochemically activated solution need not be diluted or possibly diluted to a lesser extent if a higher concentration solution is required.

Devices designed to produce mixed oxidant solutions electrochemically typically comprise components such as pumps, valves, tubing, cells, power supplies and sensors. Many of these components, particularly valves and pumps, are designed to operate within specified ranges. Therefore, electrochemical activation (ECA) devices designed to produce at concentrations of different orders of magnitude typically require duplicated/multiple components, hydraulic circuits and associated controllers to produce streams of different concentration. It is a feature of the design of the device claimed in this application that this same result is achieved with one set of components, greatly reducing the production cost of the device. There device of the invention does not produce two or more streams from the electrochemical cell.

Cells such as those described in this application may be of different geometries. Flat plate cells may be used. In one preferred embodiment of this invention the cell design is cylindrical.

The low power consumption of such devices allows for the use of smaller, external power supplies, familiar to consumers and common to many consumer devices. This reduces the cost of the device and improves product safety.

The present invention also provides a kit comprising:

(i) a device according to the present invention; and (ii) a container holding a brine solution.

The brine solution may be within a reservoir in the device. Alternatively the brine solution may be provided in a container that can be emptied into or attached to the device. For example the container could be one which is screw threaded onto the device of the invention.

The device of the invention may have a suction tube for insertion into the container. This allows for uptake of the brine solution.

As discussed above the brine solution may further comprise a component for suppressing/neutralising the sodium hydroxide produced by the electrochemical cell. For example the component for suppressing the production of sodium hydroxide by the electrochemical cell is an acid or a buffer, for example hydrochloric acid.

The component for suppressing the sodium hydroxide may be used to impart a pH of from about 5 to 8 such as 6 to 7.5, for example 6.5 to 7.5, optionally 6.5 to 7.2 such as about pH 7 to the electrochemically activated solution.

It will be appreciated that the brine solution may be made to a desired sodium chloride concentration that is optimised for the operational parameters of the electrochemical cell.

Optionally the brine solution further comprises a corrosion inhibitor or a preservative such as an antimicrobial agent.

A device of the invention can have a start-up time as low as 3 to 4 seconds. That is from the moment it starts to the moment it is producing the desired electrochemical solution is very short.

In one arrangement the final volume of solution produced in one production cycle is 1.5 to 2 litres. The device of the invention can get a desired ppm of FAC within 10 to 15% range of a desired level in a very short time.

The present invention also provides a brine solution for use in the device according to the invention.

The brine solution according to the invention may further comprise a component for suppressing sodium hydroxide produced by the electrochemical cell.

In the brine solution according to the invention the component for suppressing the production of sodium hydroxide by the electrochemical cell may be an acid or a buffer.

In the brine solution according to the invention the component for suppressing the production of sodium hydroxide by the electrochemical cell may be hydrochloric acid.

In the brine solution according to the invention the component for suppressing the production of sodium hydroxide may be used to impart a pH of from about 5 to 8 such as 6 to 7.5, for example 6.5 to 7.5, optionally 6.5 to 7.2 such as about pH 7 to the electrochemically activated solution.

In the brine solution according to the invention the brine solution may further comprises a corrosion inhibitor or a preservative such as an antimicrobial agent.

It is appreciated the component for suppressing the production of sodium hydroxide may be added as a constituent of the precursor brine or possibly added to the precursor water or added separately before during or after the electrochemical process.

DETAILED DESCRIPTION OF THE INVENTION

Hypochlorous acid is a powerful biocide, effective against a broad spectrum of pathogens. It is formed by the hydrolysis of chlorine gas to form an aqueous solution. It is an unstable chemical species and will react to form decomposition products such as chloride, oxygen and chlorate. Therefore, it is highly desirable to produce hypochlorous acid biocidal solutions immediately prior to use.

The hydrolysis of chlorine to form hypochlorous acid necessarily entrains chloride ion in the biocide solution as one mole of salt is produced with one mole of hypochlorous acid when a pH neutral solution of hypochlorous acid is formed from the hydrolysis of chlorine. This is the minimum ratio possible but all ECA technologies result in solutions with higher chloride ratios than the minimum.

Hypochlorous acid reacts to form hypochlorite at alkaline pH. The pKa for the interconversion of hypochlorous acid and hypochlorite is 7.5. Collectively hypochlorous acid and hypochlorite are known as free available chlorine (FAC). Hypochlorite is a much poorer biocide than hypochlorous acid and the pH of FAC solutions should be optimised to neutral pH to maximise the concentration of hypochlorous acid.

Solutions of hypochlorous acid are generated electrochemically in devices containing flow through electrochemical cells. Such cells comprise an anode at which chloride ion is oxidised to chlorine and immediately hydrolysed to form free available chlorine. They also comprise a cathode at which water is reduced to hydrogen gas, with hydroxide ion being a concomitant product of the reaction.

Anodes are typically of titanium coated such that the electrode is what is known as dimensionally stable. That is to say the electrode does not corrode as chlorine is produced.

Flow through electrochemical cells are of two types—divided and undivided cells. Divided cells are configured such that a permeable diaphragm or membrane is situated between the anode and cathode. The purpose of the diaphragm or membrane is to isolate the products of the anode and cathode reactions separated so that solutions of caustic (sodium hydroxide) and hypochlorous acid can be isolated.

Diaphragms are typically composed of porous ceramic and allow liquid to exchange between the chambers of the cell so that ions may carry the electrical charge and complete the circuit. Membranes are made of ionically conducting polymer and selectively allow for certain ions to be exchanged so that the circuit is completed but prevent water moving from chamber to chamber.

Undivided cells allow the products of the anode and cathode reactions to mix. The caustic (sodium hydroxide) produced at the cathode neutralizes the hydrochloric acid produced by the hydrolysis of chlorine gas, produced at the anode. Caustic is produced at a higher rate at the cathode than acid is formed by hydrolysis of chlorine and therefore the pH of solutions produced in undivided cells is alkaline and FAC exists as hypochlorite.

Voltage is applied to electrochemical cells to drive electrochemical reactions. The cell can be modelled as a series of resistors across which the cell voltage drops in series. Therefore, there is a potential drop associated with the anode reactions, the resistance of the cell solution, the cell separator (be that a diaphragm or membrane) and the cathode reactions.

In order to produce the chemical species with the lowest requirement for energy and also so that unwanted by-products are minimised. Cells containing diaphragms require the application of high voltages as the porous ceramic presents a high impedance to current flow. High saline concentrations are also required in order to minimise the problem resulting in low conversion of chloride to FAC and therefore highly corrosive solutions.

The device of this application circumvents the limitations of using undivided cells, namely the production of hypochlorite solutions instead of hypochlorous acid solutions, by utilising a brine reservoir comprising dilute brine and an additive such that the excess caustic produced in the undivided cell is neutralised. The additive can comprise chemical species such as acids, preferably hydrochloric acid, or buffers. The concentration of additive(s) can be set such that the final pH of the product solution is of the desired value. The use of an acid additive is illustrated in example 1.

Example 1: A cell, without diaphragm or membrane, was constructed with an electrode separation of 1 mm and a cell volume of 5 ml. Two solutions were prepared. Firstly, solution A, a dilute brine was formulated. Secondly, solution B, a dilute brine and HCl was formulated. In separate experiments the solutions were pumped through the cell. Electric potential was applied to the cell and the pH of the product solutions were recorded.

TABLE 1 pH of product solutions produced without brine acidification (A) and with brine acidification (B).

| Solution | pH |
|---|---|
| A | 9.3 |
| B | 6.8 |

The results of example 1 clearly demonstrate that the use of brine acidification enables solutions of close to neutral pH to be produced from single chambered cells, without which the pH of the solution would be alkaline.

The use of a brine reservoir is advantageous in comparison to using a brine saturator, in which the salt is contacted with water in order to generate a brine solution in-situ. The concentration of brine developed by such methods can be of variable strength but most often is necessarily saturated brine limiting the scope for design of the ECA device. Furthermore, the addition of additives to a brine saturator could not result in consistent absolute or relative concentrations of different chemical species in the produced brine.

In this regard the use of a brine reservoir is also advantageous for the generation of solutions with enhanced mixed oxidant concentrations. Salts such as sodium chlorite may be added to the reservoir, and chlorite may be oxidised to chlorine dioxide at the cell anode, or through secondary chemical reactions.

The brine may be used in the cell undiluted or be mixed with water before being introduced into the cell. The brine and diluent may be pumped into the cell, for example the brine by a brine pump and/or the diluent by an electrolytic cell pump, or they may flow in by gravity. The water may be taken directly from a reservoir or from a mains supply. The water may be processed to purify it before entering the cell. The brine may be entrained in a water flow by means of an eductor.

The absence of a diaphragm results in lower cell voltages. This application describes further reductions in cell voltages, achieved by optimising the electrode separation distance. The resistance of the solution between the anode and cathode is determined by the concentration of ionic species in the cell solution and the electrode separation distance, i.e. the distance between the anode and the cathode. Solution resistance decreases as the concentration of ionic species increases and electrode separation distance decreases. However, bridging of the electrode gap with gas can occur if the distance is too small, resulting in poor cell performance, and therefore an optimum electrode separation distance can be determined.

In thin layer electrochemical cells such as described in this application practically the entire volume of the cell contacts the electrode surfaces as it transits through the cell. This allows very high conversion rates of reactant to product and therefore minimises the chloride transferred to the product solution.

The advantages of reducing electrode separation distance in reducing cell voltages and reducing chloride concentration are demonstrated in example 2.

Example 2: Two cells, without diaphragm or membrane, were constructed, one with an electrode separation of 3 mm (30 ml cell volume) and one with an electrode separation of 1 mm (5 ml cell volume). A dilute brine NaCl was formulated. Brine was pumped through the cell and a voltage was applied to the cell. Residual chloride concentrations were calculated for the solutions.

TABLE 2

| Data for 3 mm electrode separation. | |
|---|---|
| [FAC] (ppm) | [Chloride] (ppm) |
| 146 | 2,223 |

TABLE 3

| Data for 1 mm electrode separation. | |
|---|---|
| [FAC] (ppm) | [Chloride] (ppm) |
| 280 | 2,156 |

The data in example 2 clearly illustrates the higher FAC synthesis rates and chloride conversion for a cell of lower electrode separation.

It is also readily understood that the variation of brine concentration for cells of the same electrode separation allows for product biocide concentrations to be varied.

Cells used according to this invention may be of different geometries. For example, they may be flat plate or cylindrical. Certain cell designs, primarily cylindrical cells, allow certain mechanical advantages such as sealing by O-ring instead of gasket and are preferred.

In many consumer applications the disposal of waste solutions is a significant drawback to the operation of a device. Cells with two chambers necessarily generate a stream of excess caustic from the cathode. Such streams may be hazardous to human health and the environment. Furthermore, single stream devices of defective design may be such that significant quantities of understrength solution may be generated on device start-up.

It is also a requirement in many consumer applications such as dental unit waterline disinfection that small volumes of low concentration solution are required necessitating the generation of small absolute quantities of oxidant, in a reproducible fashion from run to run and device to device. By way of example it is common in dental unit waterline disinfection to produce 1.5 litre quantities of oxidant at <10 ppm concentration, or <15 mg of oxidant in total.

The device claimed in this patent takes advantage of the use of accurately formulated reactant solutions (such that the electrolysed solutions are of consistent composition), accurate dosing pumps, optimised spacing of the anode and cathode (such that maximised chloride to FAC conversions are enabled) and cell volume is minimised and an optimised current control system so that start-up cell volumes, as defined elsewhere in this application, are no more than 15 ml and start-up residence times are 30 seconds or less.

Example 3: Two cells, without diaphragm or membrane, were constructed, one with an electrode separation of 1.0 mm (A, 5 ml cell volume) and one with an electrode separation of 3.0 mm (B, 30 ml cell volume). A brine of NaCl and HCl was formulated. Brine was pumped through the cells and both cells contained only brine when voltage was first applied. A voltage was applied to cell A and a higher voltage was applied to cell B. Samples of approximately 5 ml volume were collected sequentially and analysed for FAC concentration until such time as the concentration of FAC in the sample was 90% of the steady state operating concentration.

TABLE 4

| Start-up data for 1 mm electrode separation, cell A. | | |
|---|---|---|
| Cumulative Sample Volume (ml) | % of steady state concentration | Residence Time (s) |
| 5 | 0% | 10 |
| 10 | 58% | 20 |
| 15 | 84% | 30 |
| 20 | 91% | 40 |

TABLE 5

| Start-up data for 3 mm electrode separation, cell B. | | |
|---|---|---|
| Cumulative Sample Volume (ml) | % of steady state concentration | Residence Time (s) |
| 5 | 9% | 14 |
| 10 | 33% | 24 |
| 15 | 59% | 34 |
| 20 | 62% | 44 |
| 25 | 77% | 54 |
| 30 | 83% | 66 |
| 35 | 85% | 78 |
| 40 | 101% | 91 |

The data in tables 4 and 5 shows that cells of lesser electrode separation result in quicker start up times and more importantly less solution must pass through the cell before the steady state concentration is achieved. This is important for accurate formulation of small batches of biocide solutions when the device must be operated such that no waste solutions are generated, such as for generating disinfectant solutions in dental applications.

The device is further designed such that solutions with concentrations of different orders of magnitude can be synthesized from the same device. This is achieved using the same advantages listed previously.

The low power consumption of such devices allows for the use of smaller, external power supplies, familiar to consumers and common to many consumer devices. This reduces the cost of the device and improves product safety.

BRIEF DESCRIPTION OF THE DRAWINGS

Embodiments of the invention will be described, by way of example only, with reference to the accompanying drawings in which:

FIG. 1 presents a preferred embodiment of the invention where brine is drawn from a reservoir and mixed with water drawn from another reservoir such that said solution is electrolysed in a flow through electrochemical cell to generate a biocidal oxidant solution. Said solution is diluted in water drawn from the water reservoir and dispensed into a receiving vessel such as a bottle.

DETAILED DESCRIPTION OF THE DRAWINGS

FIG. 1 shows a preferred embodiment of the invention. Brine is drawn from a brine reservoir 102 using a brine pump 104. The brine in the brine reservoir 102 is preformulated and supplied to the end user in a bottle that can be attached to the device by means of a threaded connection. The water reservoir 106 is integrated into the device and preferably filled with deionised water. Water is pumped from the water reservoir by the electrolytic cell pump 108 and mixed with the brine in tubing before the flow through electrochemical cell 110 to dilute it to the correct concentration. The electrolytic cell 110 is preferably cylindrical and preferably has an electrode separation of 1 mm or less. There is no diaphragm or membrane in the cell. The anode is connected to the positive end of a DC power source/supply 112 and the cathode to the negative end. The solution is electrolysed to form the biocide solution. The biocide solution is dosed into water pumped from the water reservoir 106 by a water pump 114 and diluted to the final concentration which is delivered to a product container 116. The system is controlled by a control system so that solutions of different biocide concentration can be formed.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A device for producing biocidal solutions comprising a flow through undivided electrochemical cell for electrochemically activating an electrolyte to produce an electrochemically activated solution which is biocidal, the electrochemical cell having an anode and a cathode, wherein the separation between the anode and the cathode is less than 3.2 mm and the electrochemical cell having a capacity to hold no more than 20 ml of electrolyte within the electrochemical cell, the device further comprising a voltage control for maintaining a voltage of between 2 and 7.5 volts across the electrochemical cell and wherein the voltage control is configured to control the current drawn by the electrochemical cell so that a constant current is maintained.

2. A device according to claim 1 wherein the separation between the anode and the cathode is no more than 2.8 mm.

3. A device according to claim 1 wherein the electrochemical cell has a capacity to hold no more than 18 ml of electrolyte.

4. A device according to claim 1 wherein the electrochemical cell has a capacity to hold no more than 8 ml of electrolyte.

5. A device according to claim 1 that is configured to run in production cycles so as to produce a predetermined amount of electrochemically activated solution and then cease production when the predetermined amount of electrochemically activated solution is produced.

6. A device according to claim 1 which is automated to, flush residual electrolyte from the electrochemical cell after a production cycle of electrochemically activated solution ceases.

7. A device according to claim 6 comprising a flush system wherein a liquid is used to flush residual electrolyte out of the electrochemical cell.

8. A device according to claim 6 wherein the flushed residual electrolyte is retained within the device.

9. A device according to claim 6 wherein the device has a discharge conduit for discharging electrochemically activated solution from the device and the flushed residual electrolyte is retained within the discharge conduit.

10. A device according to claim 9 wherein the discharge conduit includes a U-bend tube.

11. A device according to claim 6 wherein the device is configured so that the flushed residual electrolyte is mixed with a volume of electrochemically activated solution produced from a subsequent production cycle wherein the volume of electrochemically activated solution with which it is mixed is at least 10 times the volume of the flushed residual electrolyte.

12. A device according to claim 6 wherein the device is configured so that the flushed residual electrolyte and the liquid that flushed it are both mixed with a volume of electrochemically activated solution produced from a subsequent production cycle wherein the volume of electrochemically activated solution with which it is mixed is at least 10 times the combined volume of the flushed residual electrolyte and the liquid that flushed it.

13. A device according to claim 1 wherein the voltage control is used to control the electrochemical activation of the electrochemically activated solution.

14. A device according to claim 1 further comprising means for applying a DC voltage to the electrochemical cell.

15. A device according to claim 1 further comprising means for controlling the current in the electrochemical cell.

16. A kit comprising:

(a) a device according to claim 1; and (b) a container holding a brine solution.

17. A kit according to claim 16 wherein the brine solution further comprises a component for suppressing sodium hydroxide produced by the electrochemical cell, and wherein the component for suppressing the production of sodium hydroxide by the electrochemical cell is an acid or a buffer.

18. A kit according to claim 17 wherein the component for suppressing the production of sodium hydroxide is used to impart a pH of from about 5 to 8 to the electrochemically activated solution.

* * * * *